United States Patent [19]

Bruning

[11] 4,188,881

[45] Feb. 19, 1980

[54] AUGMENTING DUPLICATOR PRODUCTION

[75] Inventor: Edwin C. Bruning, Palantine, Ill.

[73] Assignee: AM International, Inc., Los Angeles, Calif.

[21] Appl. No.: 819,720

[22] Filed: Jul. 28, 1977

[51] Int. Cl.[2] ..... B41F 5/02

[52] U.S. Cl. ..... 101/141; 101/232; 270/1

[58] Field of Search ..... 270/1-5, 270/12-15, 17, 18, 21; 101/141-142, 144, 231, 232, 237, 238, 240, 130, 132, 132.5, 136, 137, 216-218

[56] References Cited

U.S. PATENT DOCUMENTS

| | | | |
|---|---|---|---|
| 1,586,915 | 6/1926 | Pendergast | 270/1 |
| 3,982,743 | 9/1976 | DeRoo | 270/1 |
| 3,987,722 | 10/1976 | Goodwin | 101/91 |

*Primary Examiner*—Edgar S. Burr

*Assistant Examiner*—A. Heinz

*Attorney, Agent, or Firm*—Anthony W. Karambelas; George Jameson; Russell L. Root

[57] ABSTRACT

The description deals with a process of duplicating page order sheets designed to greatly augment the output of existing office duplicators by preparing masters each of which carries the image of two pages of data. The master is placed on the cylinder with the page lengths axially disposed and the page widths peripherally disposed, and prints on long sheets each of which carries two pages of data side by side, each being placed in successive pockets of a collator. The stack of printed sheets in each pocket is then placed in a paper stack cutter and cut into two stacks of standard sized sheets. The present invention relates to the discovery that a certain page order sequence of originals can be devised which will allow the whole process to proceed in an orderly routine manner, materially simplifying the procedure for the operator.

13 Claims, 18 Drawing Figures

AUGMENTING DUPLICATOR PRODUCTION

BACKGROUND OF THE INVENTION

This invention relates to duplicating and especially to means for multiplying the output of existing lithographic duplicators of the type used in offices and in-house duplicating departments, particularly when reproducing multipage documents. It deals primarily with the problems of how to rapidly prepare multipage masters, and especially how to prepare such masters so that they can be used in a routine sequence which will generate copy sheets capable of being directly collated in a manner to produce finished copy or substantially finished copy.

There have recently been developed duplicators with on-line master makers and collators which can accept an original and can automatically carry the production process through to the presentation of assembled sheets in the pockets of a collator. The present invention has devised special techniques for utilizing such equipment in a manner to maximize its output in terms of printing more than one page per impression, and especially to do so even when it is desired to provide in each collator pocket a work product consisting of a set of finally ordered or substantially finally ordered pages.

SUMMARY OF THE INVENTION

The present invention consists of the discovery that it is possible to greatly multiply the output of existing duplicators by the way in which the work is handled. It has been known that one of the standard master cylinders supplied on duplicating machines was so arranged that a master large enough to carry an image for a sheet 11×17 inches in size with the longer dimension extending circumferentially around the cylinder. It has likewise been known to print pages two-up on a double size sheet and then, when a run is complete, to place the stack of printed sheets in a paper stack cutter and separate each of the large sheets into individual page size sheets, all at one stroke.

According to the present invention a convenient way has been found to image the master by preparing the same in a photographic master maker, for example a master maker of the electrostatic copier type. This allows the one preparing the original images, if typed, to type on standard sized sheets of paper, and to assemble these originals for use in the copier or image maker. Of course if the originals are not typed, but rather are standard sized preprinted sheets, they can be used in the same way. If the copier has a fixed exposure platen, the originals can be fed in side by side relationship onto the platen to expose the master and then fed away. In other existing duplicating equipment including an on-line master maker (for example the Addressograph-Multigraph Model 2000 or 2300 master maker), the exposure is achieved by slit scanning the original and this is the form at present preferred. With this equipmment the page originals can be arranged with their long dimensions parallel to the in-feed rollers, and the originals fed in one after another in continuously moving fashion in a contiguous array while the images which they cast are reproduced side by side on a large or double page size master sheet. In either case it is the feeding of the originals in substantial side-by-side contact which significantly speeds up the preparation of the masters and simplifies their control so that any attention which the operator must give to their proper order or orientation is not seriously interfered with.

It is a particular feature of the invention that when making copies of documents embodying several pages in which a particular page order must be maintained, there is provided a process involving presequencing of the originals and so feeding them to the master maker, two by two, that the automatically collated output of the duplicator is ready for cutting and assembly without significant intervening sorting or treatment, and with minimum demands upon the operator.

DESCRIPTION OF THE PREFERRED EMBODIMENT

Figure 1:
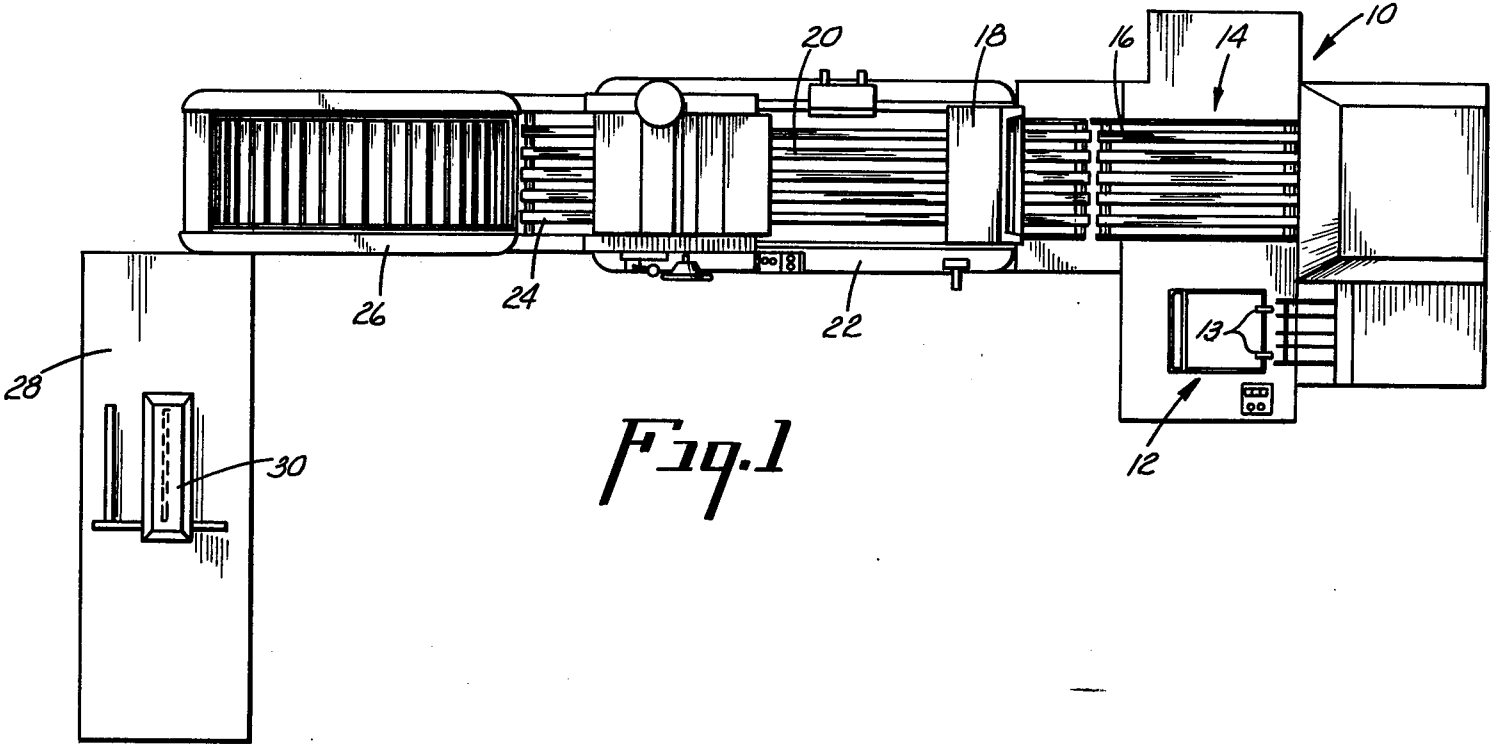
FIG. 1 is a top plan of a duplicator and auxiliary equipment used in carrying out the present invention.

Referring first to FIG. 1, there is here illustrated a duplicating set-up suited to the high production process outlined above. A master maker (in this instance an Addressograph-Multigraph Model 2000 electrostatic master maker) is illustrated at 10. This includes an original input station 12 including an original forwarding or feeding means, such as feed rollers 13 and a master delivery station at 14. Since this master maker is on-line, the delivered master is carried by a belt transport 16 directly to a master converter or conversion station 18, where the surface is treated to make to background areas hydrophilic, and the master is carried from there to the master cylinder (not shown) of a lithographic duplicator 22 (in this case corresponding to an Addressograph-Multigraph duplicator, Multilith Model 2850) by a master insertion ramp or transport 20 where it is introduced to the master cylinder of the duplicator 22 and clamped in position thereon.

The organization thus far described represents an Addressograph-Multigraph Total Copy System, Model 4150.

In the arrangement shown in FIG. 1, the printed copy sheets issuing from the duplicator 22 are carried by a transport 24 to a rotary drum collator 26 and deposited in the pockets thereof.

A work surface 28 is shown contiguous with the collator 26, and associated therewith is a sheet stack cutter 30 of conventional construction.

The manner in which the method of this invention is carried out is perhaps best described with reference to FIGS. 2 to 6, taken in conjunction with FIG. 1.

In this description reference will be made to "letter size" sheets and "double letter size" sheets. By the former expression is meant copy sheets of usual letter size, i.e. about 8-½ by 11 inches such as commonly used in the United States, or perhaps A4 European standard sheets (8.27×11.69 inches or 210×297 mm) or B5 Japanese standard (7.17×10.12 inches or 182×257 mm). For the purpose of this description any copy sheet within this general range of sizes will be recognized as falling within the expression. The expression "double letter size" will accordingly be understood to denote a copy sheet which has double the area of whatever letter size sheet has been selected, and in which the length is equal to two letter size sheet widths and the width is equal to one letter size sheet length. When a corresponding "double letter size" qualifier is applied to the master sizes, this will be readily understood as identifying a master whose size is suitably proportioned for printing upon a double letter size copy sheet. Normally this will be slightly larger than the double letter size copy sheet to provide desirable overhang margins and a lead edge margin for clamping by the duplicator cylinder.

Figure 4:
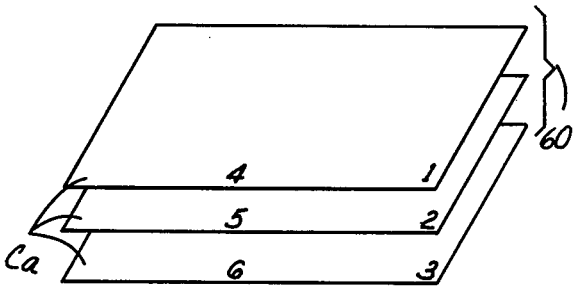
FIGS. 4, 5 and 6 illustrate diagrammatically the copy sheet arrangements at various stages in the process of forming a booklet of related pages.

The operator first loads the duplicator with double letter size copy sheets seen, for example, in FIG. 4. She also loads the master maker supply hopper with double letter size master sheets. She then prepares suitable masters by feeding a first letter size original into the original feeding means or feed rollers 13 of the master maker 10, and then as that original is fed forward, long edge foremost, feeding a second original, long edge foremost so as to be in substantially contiguous side to side relation with said first original as they move through scanning position. This causes the images of the two letter size masters to appear side by side on a single double letter size master.

As the imaged master emerges at the delivery station 14 it is carried to the converter 18 where its surface is treated to render the background areas hydrophilic, and thence it moves to the master cylinder of the duplicator 22.

As the duplicator operates it prints a series of double letter size copy sheets (FIG. 4) which are conducted to a suitable receiver.

Figure 5:
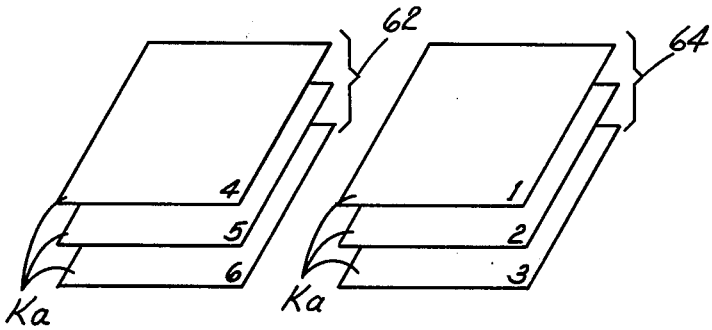

When the run is finished the operator merely lifts the stack of printed sheets from the receiver, jogs them into alignment on the surface 28 (or using specific jogging equipment if provided), sets the stack under the blade of the cutter 30 which clamps and cuts the stack into two sections as seen in FIG. 5.

While the cutting operation just described is the preferred procedure by reason of simplicity and minimum capital equipment requirement, it will be appreciated that cutting the sheets by means of a conventional slitter en route to a collection point such as a receiver or collator pocket will provide the same result and is regarded as the full equivalent.

As can be seen from the foregoing description, the thus far outlined process greatly increases the page output of the duplicator by providing a highly expeditious method for imaging the double letter size masters required in the two-up printing procedure.

PRINTING OF PLURAL PAGE DOCUMENTS

The output increasing process just described is particularly adapted for the printing of plural page documents using in the procedure the collator 26.

In order to carry out this process, the operator first arranges the single letter size originals (which will be used to make the masters for her documents) in sequence, for example 1, 2, 3, 4, 5, 6, if the document has six pages. It is only necessary to make certain that the number of originals is an even number, and if an odd number is found, to add a blank original at the top or bottom of the stack, or at any other appropriate location so that the number of originals will be an even number.

In this description hereafter, page numbers are used as representations of the desired page position within the finished booklet and have no necessary relationship to actual numbers which may appear on the pages themselves. This is done in order to simplify and generalize the discussion. Whenever the expression "characterized as odd" or "characterized as even" is used hereinafter, it will be understood that this refers to the character of the number of the order position of the original (or a blank insert) in the sequence, whether or not there exists any visible numerical designation thereon, and irrespective of whether any designation actually printed thereon is odd or even.

The stack of originals is then divided at the midpoint to provide two stacks, for example, with the originals for pages 1, 2, 3 in order in the first stack and those for pages 4, 5, 6 in order in the second stack.

With the particular type of master maker shown in the drawing, the originals are required to be presented face down to the illumination station, so the stacks or originals are inverted. They are shown for convenience, placed in upper and lower pack holders 40 and 42 in FIG. 2, the first portion (e.g. originals for pages 1–3) in holder 40 and those for the second portion (e.g. originals for pages 4–6) in holder 42. From these the originals are duly fed to the input station 12 in accordance with a simple formula.

Figure 2:
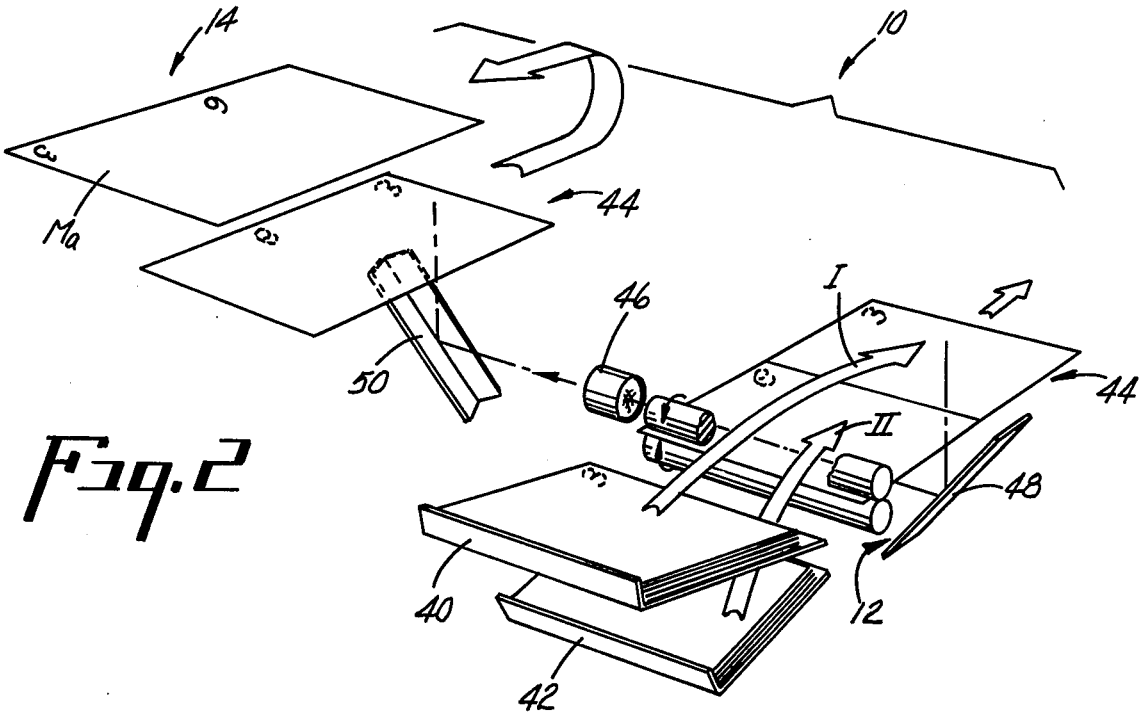
FIG. 2 is a diagrammatic perspective illustrating one manner of imaging a master in accordance with the process of the invention.

First the operator takes the top original from the pack in holder 40 (namely the original for page 3) as indicated by arrow I in FIG. 2, and then the top original from the pack in holder 42 (page 6) as indicated by arrow II in FIG. 2. These two are advanced in tandem by the operator so as to have the relationship to each other desired on the master, and in most cases they would be substantially contiguous as shown. The conventional forwarding or feeding means for the originals, such as feed rollers 13, which forms an integral part of the master maker 10, forwards the originals through the illumination station 43 in tandem array, and then out.

Images of these two originals are formed in tandem on a double letter size master sheet $M_a$ which is fed in a known manner to an exposure station 44. Exposure is accomplished by an optical system consisting of a lens 46 and mirrors 48 and 50. The machine, in a well-known fashion, then develops and fixes the master image and inverts the same, end-over-end, presenting it face up at the discharge station 14.

The transport 16 (FIG. 1) conveys the master $M_a$ to the conversion station 18 where it is treated in customary fashion to establish the appropriate lithographic properties, and then it is advanced by transport 20 to the cylinder of the duplicator 22 where it is installed and the printing operation commences.

As the printed double letter size copy sheets are produced by the duplicator, they are inserted face up, each into a separate bin of the collator 26 in a well-known manner, until the required number have been made, whereupon printing is stopped.

At this point, then, following the format of the specific example, there is one double letter size copy sheet face up in each collator pocket with pages 3 and 6 printed thereon.

The operator then repeats the feeding procedure for originals, and this time with the originals next on the stack, which will be for pages 2 and 5. These will create a single master with the images of pages 2 and 5 in tandem array. Copy sheets are printed and collated as described above so that now each pocket of the collator has two double letter size face-up copy sheets, a bottom one with pages 3 and 6, and an upper one with pages 2 and 5.

A further repetition of the above-described series of steps results in three double letter size copy sheets in each collator pocket, the one now on top displaying pages 1 and 4. In other words, the contents of each pocket will be as shown diagrammatically in FIG. 4, and consisting of a stack 60 of copy sheets $C_a$.

Figure 3:
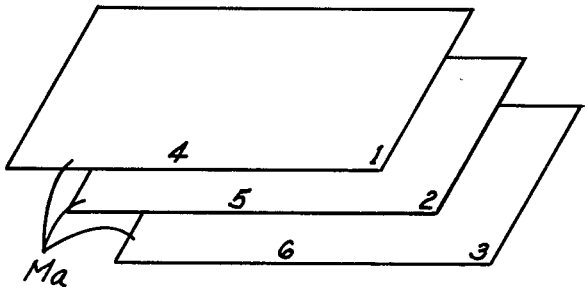
FIG. 3 illustrates the progression in which the imaged masters issue from the master maker.

While the preparation of a master and printing from the same has been described in direct association, it will be understood that normally the master making will proceed in advance of or in concert with duplication so that, in effect, a sequence of masters $M_a$ as illustrated in FIG. 3 will be presented for use in turn on the duplicator.

To complete the work, the operator merely empties a collator pocket of the stack 60, jogs the sheets into aligned position, places the stack in the cutter 30, which is then operated to separate the stack into two equal size stacks 62 and 64 of smaller size copy sheets $K_a$ as seen in FIG. 5.

Figure 6:
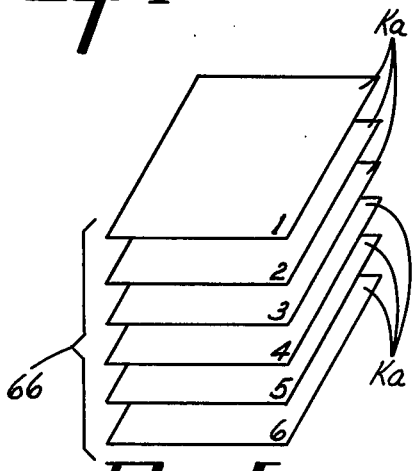

By placing one stack upon the other (in this case the right-hand stack 64 on top of the left-hand stack 62 as seen in FIG. 5) there is produced a composite booklet 66 diagrammatically shown in FIG. 6 with the sheets all in proper order.

When the sheets are rejogged and stapled, one booklet is complete and the procedure of the two paragraphs immediately foregoing is repeated for each pocket of the collator until all of the booklets are complete.

The foregoing description calls for withdrawing an original first from the stack in holder 40, then from the stack in holder 42, but it will be understood that this order can be reversed throughout the operation, in which case the result will be the same, provided that, after cutting the stack of double size copy sheets, the merging of the resulting single size copy sheets $K_a$ is so conducted as to place the stack with lower number pages on top of the other stack. The operation can also be similarly conducted whether the lower number pages are placed in the upper holder 40 or the lower holder 42.

While previous description mentions cutting the copy sheets for each book individually, it will be understood, of course that the contents of any desired number of collator pockets can be stacked (up to the capacity of the stack cutter) and all cut at one stroke if desired. Then the sheet stack portion pertaining to each booklet can be assembled and stapled as described above.

From the foregoing description it is readily apparent that the production of a conventional duplicator can be significantly increased in the case of jobs requiring pages in a predetermined order, without undue complexity or complication in the operation.

TWO-SIDE PRINTING (SINGLE HEAD)

While the description so far has proceeded on the basis of improving the output of a conventional single head duplicator where the sheets are printed on one side only, it will be realized that similar benefits can be achieved with regard to two-side printing by merely taking the double letter size copy sheets after the first printing and, without cutting, inverting them, and printing the opposite face with two additional images. Then, after cutting, each final copy sheet will have been printed on both of its faces with the desired information.

In a two-side printing operation relating to the printing of booklets involving specific page order, a procedure similar to that described above for one-side printing would be followed but with certain modifications.

Two approaches for this procedure are shown in the drawing and described herein, one with respect to FIGS. 7 to 12, and the other with respect to FIGS. 13 to 16.

Figure 7:
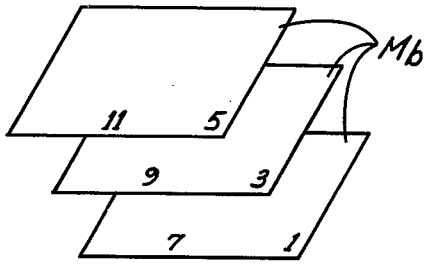
FIGS. 7 to 12 illustrate diagrammatically one arrangement of masters and copy sheets at various stages in the process of forming a booklet of related pages in which each copy sheet carries printing on both faces.
Figure 8:
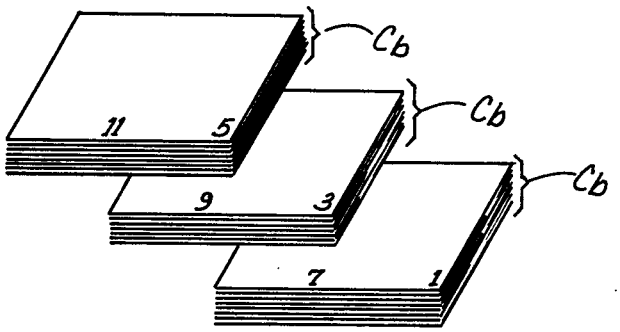
Figure 9:
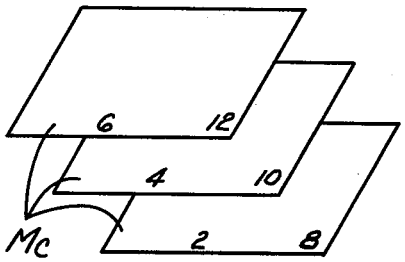
Figure 10:
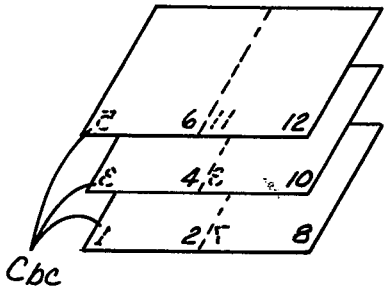
Figure 11:
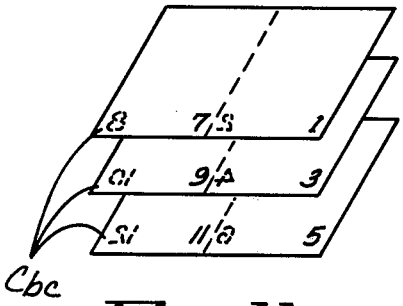

First the originals, in either case, would be handled in two separate batches of odd and even numbers, e.g. 1, 3, 5, 7, 9, 11 and 2, 4, 6, 8, 10, 12. It is here noted that the total number of pages must be adjusted, if necessary, so that the ultimate characterization number is divisible by four, and therefore each stack of originals, odd or even, will be divisible by two. In the first form, FIGS. 7 to 12, the masters would be prepared for the odd numbered pages by feeding the originals, as in FIG. 2, low-high fashion starting with the lowest number of each series, i.e. (1, 7) (3, 9) and (5, 11), and producing a sequence odd page number of masters $M_b$ as seen in FIG. 7. These masters would be run off and the copies from each, thus partially printed, would be collected in individual stacks of copies $C_b$, one stack corresponding to each master as in FIG. 8. In this connection it will be noted that the masters may be prepared and the copy sheet stacks printed therefrom in any sequence since the stacks are reserved for printing on the reverse side before collating takes place. Then a second set of masters would be prepared, this time by feeding the even numbered originals, high-low fashion, starting with the lowest number of each series, i.e. (8, 2), (10, 4) and (12, 6) to produce a sequence of even page number masters $M_c$ as seen in FIG. 9. The 8, 2 master is then run off on the back sides of the stack of sheets printed with (1, 7) and the sheets are distributed in the pockets of a collator, one to a pocket. The other two masters are similarly treated and when the operation is complete, each collator pocket has a stack of copy sheets $C_{bc}$ as seen in FIG. 10. As each stack is removed from its pocket, it is inverted to a position as shown in FIG. 11, whereupon the sheets can be jogged, cut and combined in the manner generally illustrated in FIGS. 5 and 6, and stapled to provide a booklet whose pages $K_{bc}$ would be arranged as shown diagrammatically in FIG. 12.

An alternate arrangement is shown in FIGS. 13 to 16 in which the process is like that of FIGS. 7 to 12, except that the copy sheets are first printed using the $M_c$ (even page number) masters, and then are withdrawn from the stacks to be printed on their reverse faces by the $M_b$ (odd page number) masters. The printing runs in this case take place using the masters with highest page numbers first, and the final collation produces in each pocket a stack of double sheet size copy sheets $C_{bc}$ seen in FIG. 16, which is identical with that of FIG. 11.

Figure 12:
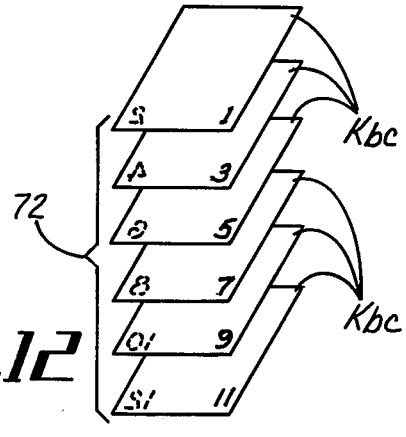
Figure 13:
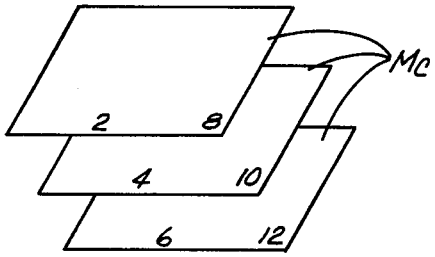
FIGS. 13 to 16 illustrate diagrammatically certain stages in a process similar to that of FIGS. 7 to 12 but with certain alternate features.
Figure 14:
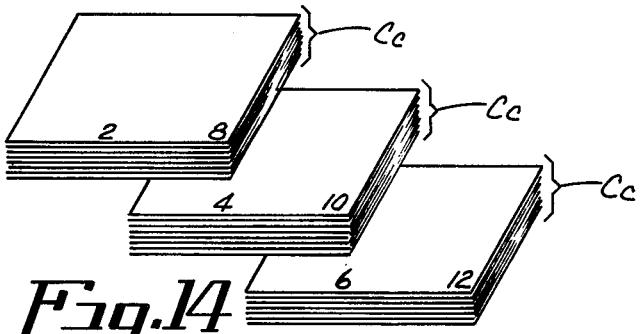
Figure 15:
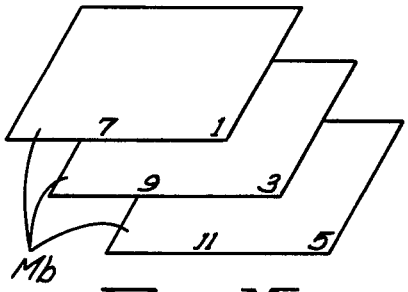
Figure 16:
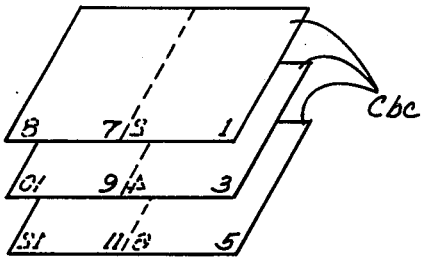

These are each removed without inverting, and after the stack is cut, the right half is placed upon the left half, and the new stack constitutes the completed booklet as already seen in FIG. 12.

In either of the two immediately foregoing types of operation (FIGS. 7 to 12 or FIGS. 13 to 16) it will be understood that equivalent results can be obtained by switching the order of drawing the originals from the stacks in the holders 40 and 42. Thus if the operator were to draw the odd numbers high-low fashion, e.g. (7, 1) then she would correspondingly draw the even numbers low-high fashion, e.g. (2, 8) to produce the pages in proper order. In other words, the system is in different to whether the originals are drawn high-low fashion or low-high fashion for either the originals characterized by odd numbers or those characterized by even numbers, so long as the other set is drawn in the opposite way.

It will also be understood that the reference to high-low fashion or low-high fashion, deals only with the manner of withdrawing the pairs of originals from their particular prepared stacks and has to do with whether the original is drawn from the stack which includes the sheets characterized by numbers towards the lower end of the particular sequence (whether odd or even), or the stack having those numbers at the higher end of the sequence.

It is understood, of course, that in all cases the originals have their top edges all oriented in the same direction, and that the stacks from which the originals are drawn are ordered for convenience in the same direction of increasing or decreasing numbers.

DUAL HEAD PRINTING

In addition, the principle of augmentation of output capacity is not alone applicable to single head duplicators, but can be equally well applied to dual tandem head duplicators as seen, for example, in U.S. Pat. No. 3,987,722 by imaging a double letter size master for each printing head and printing on first one face and then the other of each double letter size copy sheet as it goes through the machine, and finally cutting the stack of double size copy sheets to provide single letter size sheets.

Figure 17:
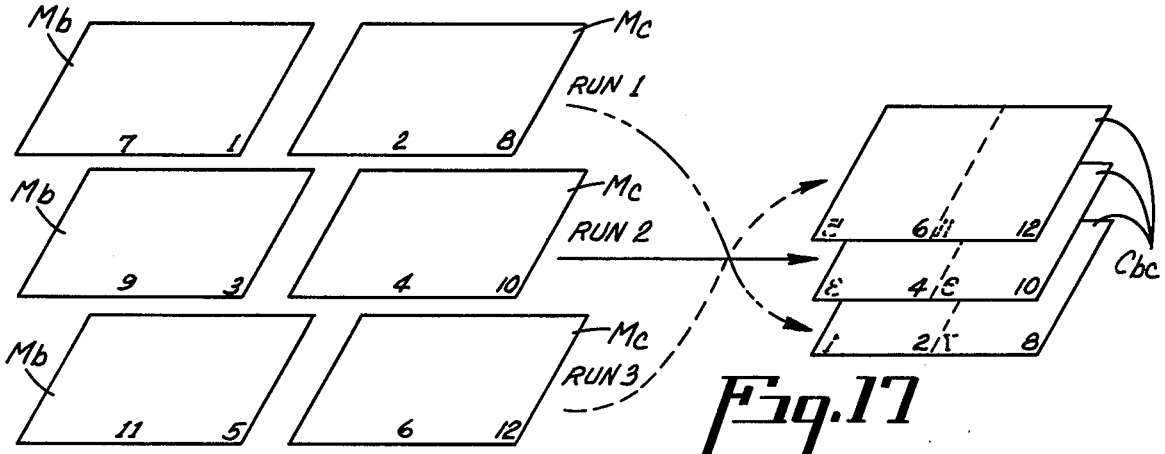
FIG. 17 illustrates diagrammatically the arrangements of masters and copy sheets at certain stages of a process for printing booklets where the sheets are printed on both sides, but using a dual head tandem duplicator instead of a single head duplicator.
Figure 18:
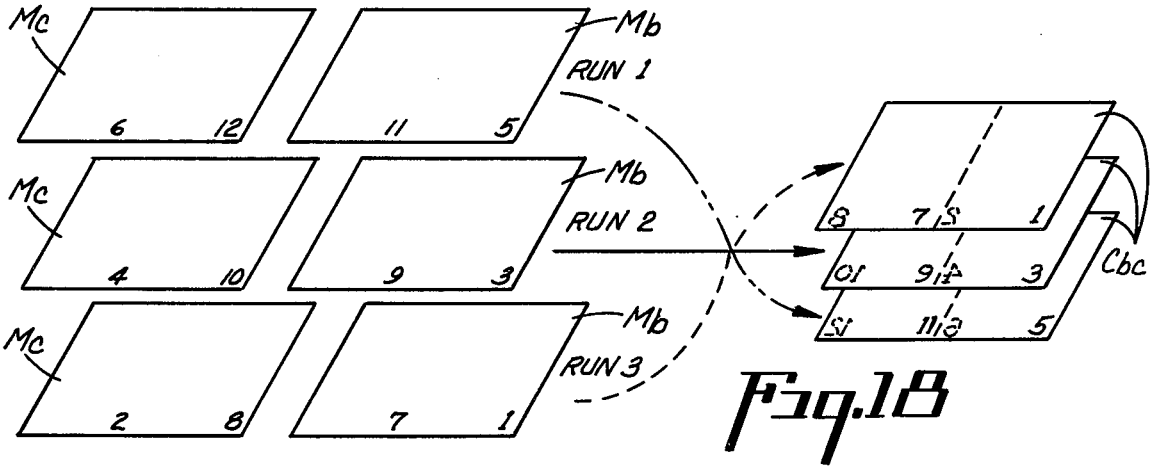
FIG. 18 is a view similar to FIG. 17 but showing an alternate arrangement.

To properly arrange page order in using this type of equipment, an arrangement as indicated in FIG. 17 or 18 can be adopted.

As seen in FIG. 17, two sets of masters $M_b$ and $M_c$ are prepared exactly as described for FIGS. 7 and 9. In run 1, the copy sheet (1, 7) printed by the first master from the $M_b$ sequence is automatically inverted and printed on its reverse side with an impression from master (8, 2) from the $M_c$ sequence, and then as each sheet is thus printed, it is fed to a separate collator pocket with the face having the odd number pages face down. After this, a second run is similarly made using the $M_b$ master (3, 9) and the $M_c$ master (10, 4) and finally a third run with the $M_b$ master (5, 11) and the $M_c$ master (12, 6). At this point each collator pocket contains a stack of copy sheets $C_{bc}$ arranged as seen in FIG. 10 which require only removing, inverting, stack cutting and placing one of the resulting stacks upon the other to provide a properly arranged booklet.

FIG. 18 shows an alternative arrangement in which the even page masters are placed on the first head and the odd page masters on the second. In this case the high number pages are printed first, and printed sheets $C_{bc}$ end up in the collator pockets in upright position as in FIG. 16, after which they do not require inverting, but are merely subjected to the other standard finishing steps of removal, stack cutting and placing one of the stacks, resulting from the cut, upon the other.

While the masters can be prepared by first drawing the odd pairs as described above, and then the even pairs, if the master maker is on line as shown in said U.S. Pat. No. 3,987,722, it will usually be more convenient to draw first an odd pair (or an even pair) and then its corresponding counterpart. This can be done by first dividing the group into odd and even small groups, and then dividing each of these at their midpoints into low number stacks and high number stacks to provide four stacks all progressing numerically in the same direction. Then the originals can be drawn in pairs first from those stacks of one type (e.g. odd) and then from the stacks of the other character (in this case even).

In the FIG. 17 arrangement, for example the originals would have been divided frist into the odd group 1, 3, 5, 7, 9, 11 and the even group 2, 4, 6, 8, 10, 12. Then each of these would be split to form the four stacks 1,3,5-7,9,11-2,4,6-8,10,12. By drawing low-high from the odd stacks and then high-low from the even stacks, the original pairs would be presented to the master maker as follows: 1,7 8,2 3,9 10,4 5,11 12,6 and would produce the result shown in FIG. 17. It is to be noted, however, that the reverse order, high-low for odd and low-high for even, would work equally well.

ALTERNATE TWO-SIDE PRINTING (SINGLE HEAD)

The sequences of originals and master arrangements described in relation to FIGS. 17 and 18 lend themselves to single head printing as well as dual head printing in that (referring to FIG. 17) copy sheets printed by a master $M_b$, such as master (1, 7), can be collected and then immediately inverted end over end and returned to the paper supply of the duplicator. These sheets would then have their opposite faces printed by an appropriate $M_c$ master, such as master (8, 2) with the collator operating so that the output is deposited one sheet to each collator pocket. By thus operating in alternating collection and collating modes, the finally collated results in each case will be the same as those shown in FIGS. 17 and 18, and may then be processed as previously described in connection with the said views.

For completeness of understanding it should be pointed out that there is some relation between the way in which originals are oriented during feeding, and the order in which the images appear upon the master. For example, referring to FIG. 2, the first pair of originals are both headed towards the operator's right as they leave the holders 40, 42, and, being fed in the order 3,6 they will produce a 3,6 master. If, however, they had been oriented with their heads towards the operator's left, this feeding order would have produced a 6,3 master, and similarly it would have required a 6,3 feeding order to produce a 3,6 master. This may be considered an optional cognate feeding order.

However, as has been noted, in the various arrangements discussed it is not material which master is fed first so long as all originals are headed the same way and the feeding order is maintained in a consistent pattern throughout the process.

To accommodate either of the above alternatives, the expression "or optional cognate order" will serve to embrace either of the alternatives indicated in the two foregoing paragraphs.

While the foregoing process descriptions have, for convenience, used as an illustration a booklet of six sheets and six or twelve pages, it will be understood that the principles can be extended in an obvious manner to booklets of any size.

It will be appreciated that, while the foregoing discussion has dealt primarily with the production of booklets made up of several printed sheets, the principle can also be applied to the preparation of simple four page booklets in which no collation of the printed sheets is required because each sheet itself constitutes a booklet. In this case the printed sheets are merely collected in a receiver, from which they can be withdrawn one by one for cutting and stapling.

Where the term "page size" sheets is used, it will, in most cases, be understood as normally being substantially synonomous with letter size, but it will be understood also, that under certain circumstances where small originals are available or where the master making equipment provides for image reduction of about 0.65 of full size, it is also possible to produce page images of smaller size than normal, for example two-up on a single letter size master for printing on letter size sheets, and that the principles of the invention described herein can be similarly applied to such smaller "page size" and "double page size" elements in the same manner as for elements of larger size.

The foregoing description has been based primarily on the use of a duplicator of the lithographic type since this is the one by far most commonly used in situations which call for convenient, high-quality, volume production. It will, however, be understood that any other type of duplicator with a master cylinder of similar proportions capable of accepting a double letter size master (i.e. a cylinder about 11 inches long and having a usable circumference of about 17 inches) could be used with similar effect from the standpoint of augmenting its production efficiency.

What is claimed is:

1. The method of duplicating using a duplicator having a master cylinder to produce copy in booklet form in which the pages have a desired predetermined order corresponding to the order of a group of a predetermined even number of preselected originals, each original having longer and shorter side edges, said duplicating method comprising the steps of:

(a) arranging the originals in the group in a desired page order to have a desired page order characterization;

(b) separating at least a portion of the arranged group into two equal size stacks by dividing in the middle of the page order;

(c) taking pairs of originals from the stacks by taking one original from one stack and then one from the other stack in rotation;

(d) preparing a master having a vertical dimension and a longer dimension from each of said pairs in turn by presenting the first withdrawn original of the pair, with its longer side edge leading, to a master imager having original feed means, and then presenting the second original of the pair in similar orientation and in substantially contiguous relationship to the trailing edge of said first withdrawn original to generate two side-by-side page images on a double page size sheet of master material;

(e) applying each thus prepared master in its turn to the master cylinder of the duplicator with the longer dimension of the master running peripherally of the cylinder, and the vertical dimension of the side-by-side page images thereon running axially of the cylinder;

(f) supplying the duplicator with double page size copy sheets;

(g) operating the duplicator to print upon the double page size copy sheets side-by-side images corresponding to those of each master;

(h) cutting the printed copy sheets to form single page size sheets; and (i) merging the single page size sheets resulting from said sheet cutting operation by placing those of lower numbered characterization on top of those of higher numbered characterization.

2. The method of duplicating using a duplicator having a master cylinder to produce copy in booklet form in which the pages have a desired predetermined order corresponding to the order of a group of a predetermined even number of preselected originals, each original having longer and shorter side edges, said duplicating method comprising the steps of:

(a) arranging the originals in the group in a desired page order to have a desired page order characterization;

(b) separating at least a portion of the arranged group into two equal size stacks by dividing in the middle of the page order;

(c) taking pairs of originals from the stacks by taking one original from one stack and then one from the other in rotation;

(d) preparing a master having a vertical dimension and a longer dimension from each of said pairs in turn by presenting the first withdawn original of the pair, with its longer side edge leading, to a master imager having original feed means, and then presenting the second original of the pair in similar orientation and in substantially contiguous relationship to the trailing edge of said first withdrawn original to generate two side-by-side page images on a double page size sheet of master material;

(e) applying each thus prepared master in its turn to the master cylinder of thee duplicator with the longer dimension of the master running peripherally of the cylinder, and the vertical dimension of the side-by-side page images thereon running axially of the cylinder;

(f) supplying the duplicator with double page size copy sheets;

(g) operating the duplicator to print upon the double page size copy sheets side-by-side page images corresponding to those of each matter;

(h) collating the duplicator output in a mechanical collator to form a plurality of collated sets;

(i) withdrawing the collated sets from the collator and cutting each set to form two stacks of single page size sheets; and (j) merging the two resulting single page size stacks of each set resulting from the said sheet cutting operation by placing the stack containing pages of lower numbered characterization on top of the stack containing the pages of higher numbered characterization.

3. The method of duplicating as set forth in claim 2 in which each of the resulting printed copy sheets is printed on one side of the sheet only, which also includes:

(b') separating the entire arranged group in the said manner; and (c') taking the said pairs by starting with the original of highest characterization number in each stack.

4. The method of duplicating as set forth in claim 2 in which there is used a single head duplicator, in which the predetermined even number of preselected originals is divisible by four and in which each of the resulting printed copy sheets is printed on both faces of the sheet, which also includes:

(b') separating the arranged group into two equal smaller groups, a first containing in order pages characterized as odd number pages 1, 3, 5—n −1 and a second containing in order pages characterized as even number pages 2, 4, 6—n;

(b") separating each smaller group into two equal size stacks by dividing each in the middle of the page order;

(c') taking pairs of originals from the stacks derived from one of said smaller groups in the manner defined in paragraph c of claim 2;

(d'-g') using the pairs of originals taken from the stacks identified in paragraph c', performing the steps of paragraphs d-g of claim 2 to form a first sequence of double letter size copy sheet stacks printed on one surface equal in number to the pairs taken from said one smaller group;

(c") taking pairs of originals from the stacks derived from the other of said smaller groups in the manner defined in paragraph c of claim 2;

(d"-e") using the pairs of originals taken from the stacks identified in paragraph c", performing the steps of paragraphs d and e of claim 2 to form a set of masters corresponding to the other of said smaller group or originals;

(f') supplying the duplicator with the partially printed double letter size copy sheets, one stack at a time from the sequence of copy sheet stacks resulting from steps of paragraphs d'-f', after inverting each stack so as to print on the unprinted face of each copy sheet; and (g') operating the duplicator to print upon each such stack of double letter size copy sheets with the appropriate corresponding master derived from the set resulting from the steps d"-e".

5. The method of duplicating as set forth in claim 4 in which the step of paragraph c' includes taking the pairs from the odd page number stacks and withdrawing the pairs in increasing numerical sequence from each stack in low-high fashion; and the step of paragraph c" includes taking the pairs from the even page number stacks and withdrawing the pairs in increasing numerical sequence from each stack in high-low fashion .

6. The method of duplicating as set forth in claim 4 in which the step of paragraph c' includes taking the pairs from the odd page number stacks and withdrawing the pairs in increasing numerical sequence from each stack in high-low fashion; and the step of paragraph c" includes taking the pairs from the even page number stacks and withdrawing the pairs in increasing numerical sequence from each stack in low-high fashion.

7. The method of duplicating as set forth in claim 4 in which the step of paragraph c' includes taking the pairs from the even page number stacks and withdrawing the pairs in decreasing numerical sequence from each stack in high-low fashion, and the step of paragraph c" includes taking the pairs from the even page number stacks and withdrawing the pairs in decreasing numerical sequence from each stack in low-high fashion.

8. The method of duplicating as set forth in claim 4 in which the step of paragraph c' includes taking the pairs from the even page number stacks and withdrawing the pairs in decreasing numerical sequence from each stack in low-high fashion, and the step of paragraph c" includes taking the pairs from the even page number stacks and withdrawing the pairs in decreasing numerical sequence from each stack in high-low fashion.

9. The method of duplicating as set forth in claim 2 in which there is used a single head duplicator, in which the predetermined even number of preselected originals is divisible by four and in which each of the resulting printed copy sheets is printed on both sides of the sheet, which also includes:

(b') separating the arranged group into two equal smaller groups, a first containing in order pages characterized as odd number pages 1, 3, 5—n−1 and a second containing in order pages characterized as even number pages 2, 4, 6—n;

(b") separating each smaller group into two equal size stacks by dividing each in the middle of the page order;

(c') taking pairs of originals from the stacks derived from the stacks derived from one of said smaller groups in the manner defined in paragraph c of claim 2;

(d'-g') using a first pair of originals taken from the stacks identified in paragraph c', performing the steps of paragraphs d-g of claim 2 to form a stack of double letter size copy sheets printed on one surface;

(c") taking pairs of originals from the stacks derived from the other of said smaller groups in the manner defined in paragraph c of claim 2;

(d"-e") using a first pair of originals taken from the stacks identified in paragraph c", performing the steps of paragraphs d and e of claim 2 to form a master;

(f") supplying the duplicator with the stack of double letter size copy sheets resulting from the steps of paragraphs d'-g', after inverting them for printing on the unprinted face;

(g") operating the duplicator to print upon such stack of double letter size copy sheets with the master deriived from steps d"-e";

(h') collating the duplicator output in a mechanical collator to form a plurality of collated sets after each printing operation as set forth in paragraph g"; and repeating the steps of paragraphs d'-g', c", d"-e", f", g" and h' except for using in each case a subsequent pair of originals from the stacks defined in paragraph c' and c".

10. The method of duplicating as set forth in claim 2 in which there is used a dual head duplicator, in which the predetermined even number of preselected originals is divisible by four and in which each of the resulting printed copy sheets is printed on both faces of the sheet, which also includes:

(b') separating the arranged group into two smaller groups, a first containing in order pages characterized as odd number pages 1, 3, 5—n−1 and a second containing in order pages characterized as even number pages 2, 4, 6—n;

(b") separating each smaller group into two equal size stacks by dividing each in the middle of the page order;

(c') forming two pairs of originals by taking one from each stack as follows:

(1) withdrawing a pair of originals from the lower end of the sequence of each odd number stack in low-high fashion; and (2) withdrawing a pair of originals from the lower end of the sequence of each even number stack in high-low fashion;

(d') sequentially preparing two masters from the original pairs withdrawn in paragraph c' by the procedure of paragraph d of claim 2;

(e') applying the odd number master to the first print head of the duplicator and the even number master to the second print head of the duplicator; repeating the steps of paragraphs c', d' and e' by using the pairs of originals in sequence from each stack until the stacks are depleted; and (h') collating the output of the duplicator concurrently with each printing run.

11. The method of duplicating as set forth in claim 2 in which there is used a dual head duplicator, in which the predetermined even number of preselected originals is divisible by four and in which each of the resulting printed copy sheets is printed on both faces of the sheet, which also includes:

(b') separating the arranged group into two smaller groups, a first containing in order pages characterized as odd number pages 1, 3, 5—n−1 and a second containing in order pages characterized as even number pages 2, 4, 6—n;

(b'') separating each smaller group into two equal size stacks by dividing each in the middle of the page order;

(c') forming two pairs of originals by taking one from each stack as follows:

(1) withdrawing a pair of originals from the lower end of the sequence of each odd number stack in high-low fashion; and (2) withdrawing a pair of originals from the lower end of the sequence of each even number stack in low-high fashion;

(d') sequentially preparing two masters from the original pairs withdrawn in paragraph c' by the procedure of paragraph d of claim 2;

(e') applying the odd number master to the first print head of the duplicator and the even number master to the second print head of the duplicator; repeating the steps of paragraphs c', d' and e' by using the pairs of originals in sequence from each stack until the stacks are depleted; and (h') collating the output of the duplicator concurrently with each printing run.

12. The method of duplicating as set forth in claim 2 in which there is used a dual head duplicator, in which the predetermined even number of preselected originals is divisible by four and in which each of the resulting printed copy sheets is printed on both faces of the sheet, which also includes:

(b') separating the arranged group into two smaller groups, a first containing in order pages characterized as odd number pages 1, 3, 5—n−1 and a second containing in order pages characterized as even number pages 2, 4, 6—n;

(b'') separating each smaller group into two equal size stacks by dividing each in the middle of the page order;

(c') forming two pairs of originals by taking one from each stack as follows:

(1) withdrawing a pair of originals from the higher end of the sequence of each even number stack in high-low fashion; and (2) withdrawing a pair of originals from the higher end of the sequence of each odd number stack in low-high fashion;

(d') sequentially preparing two masters from the pairs of originals withdrawn in paragraph c' by the procedure of paragraph d of claim 2;

(e') applying the even number master to the first print head of the duplicator and the odd number master to the second print head of the duplicator; repeating the steps of paragraphs c', d' and e' by using the pairs of originals in sequence from each stack until the stacks are depleted; and (h') collating the output of the duplicator concurrently with each printing run.

13. The method of duplicating as set forth in claim 2 in which there is used a dual head duplicator, in which the predetermined even number of preselected originals is divisible by four and in which each of the resulting printed copy sheets is printed on both faces of the sheet, which also includes:

(b') separating the arranged group into two smaller groups, a first containing in order pages characterized as odd number pages 1, 3, 5—n−1 and a second containing in order pages characterized as even number pages 2, 4, 6—n;

(b'') separating each smaller group into two equal size stacks by dividing each in the middle of the page order;

(c') forming two pairs of originals by taking one from each stack as follows:

(1) withdrawing a pair of originals from the higher end of the sequence of each even number stack in low-high fashion; and (2) withdrawing of pair of originals from the higher end of the sequence of each odd number stack in high-low fashion;

(d') sequentially preparing two masters from the pairs of originals withdrawn in paragraph c' by the procedure of paragraph d of claim 2;

(e') applying the even number master to the first print head of the duplicator and the odd number master to the second print head of the duplicator; repeating the steps of paragraphs c', d' and e' by using the pairs of originals in sequence from each stack until the stacks are depleted; and (h') collating the output of the duplicator concurrently with each printing run.

* * * * *